United States Patent [19]

Wilkens

[11] Patent Number: 4,672,745

[45] Date of Patent: Jun. 16, 1987

[54] SPORTSMAN'S TOOL HANDLE

[76] Inventor: Arnold J. Wilkens, 12185 Sherwood Ct., Hayden Lake, Id. 83835

[21] Appl. No.: 720,855

[22] Filed: Apr. 8, 1985

[51] Int. Cl.[4] ..... B25G 1/00

[52] U.S. Cl. ..... 30/340; 7/167; 30/123; 30/138

[58] Field of Search ..... 30/339, 342, 340, 312, 30/138, 123; 16/DIG. 12; 7/158, 167

[56] References Cited

U.S. PATENT DOCUMENTS

| | | | |
|---|---|---|---|
| 19,606 | 3/1858 | Henn . | |
| 1,898,422 | 2/1933 | Champlin | 30/138 X |
| 1,980,087 | 11/1934 | Rast | 7/167 X |
| 2,018,603 | 10/1935 | Case et al. . | |
| 2,439,071 | 4/1948 | Basham . | |
| 2,904,373 | 9/1959 | Dowdy et al. . | |
| 3,588,931 | 7/1969 | Jones . | |
| 3,627,007 | 12/1971 | Rieffer . | |
| 3,686,799 | 8/1972 | Doty . | |
| 3,837,024 | 9/1974 | Saunders . | |
| 4,030,150 | 6/1977 | Fisher . | |
| 4,363,147 | 12/1982 | Deweese | 7/158 |

*Primary Examiner*—E. R. Kazenske
*Assistant Examiner*—Willmon Fridie, Jr.
*Attorney, Agent, or Firm*—Keith S. Bergman

[57] ABSTRACT

A handle particularly configured for use with a plurality of blade type tool elements. Each tool element is releasably fastenable in various positions and orientations in the handle by common fastening structures. The handle provides air compartments to cause floatation in water, a stone for tool sharpening, and a flint for fire starting.

2 Claims, 7 Drawing Figures

FIG. 1
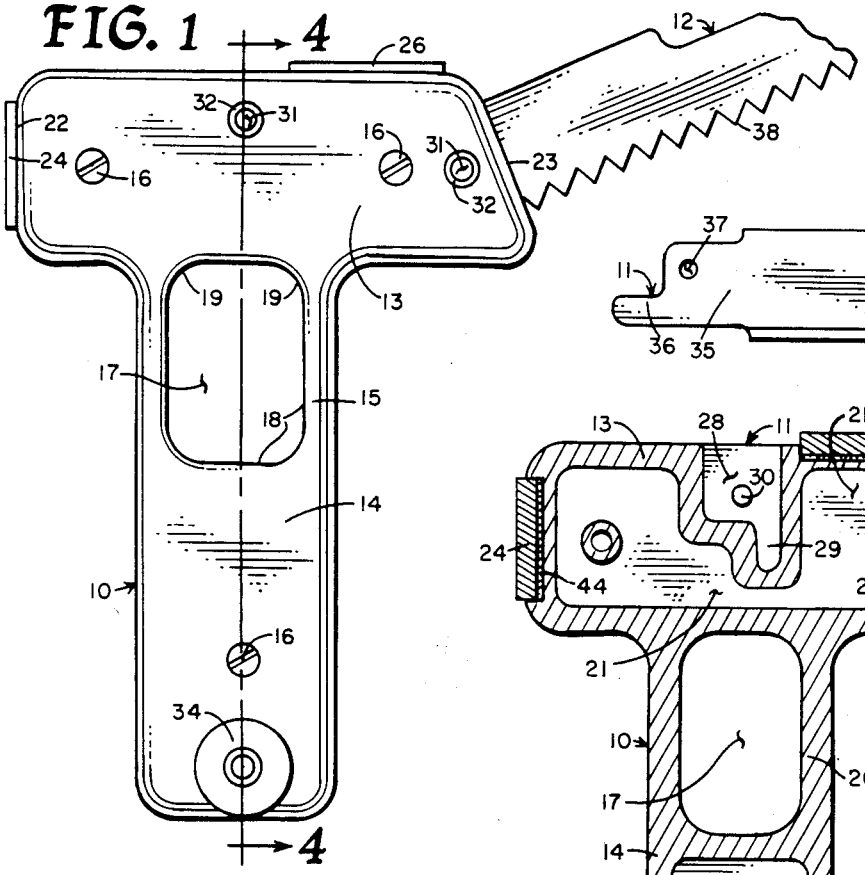
FIG. 6
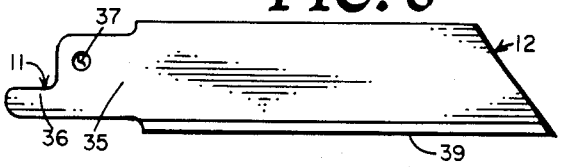
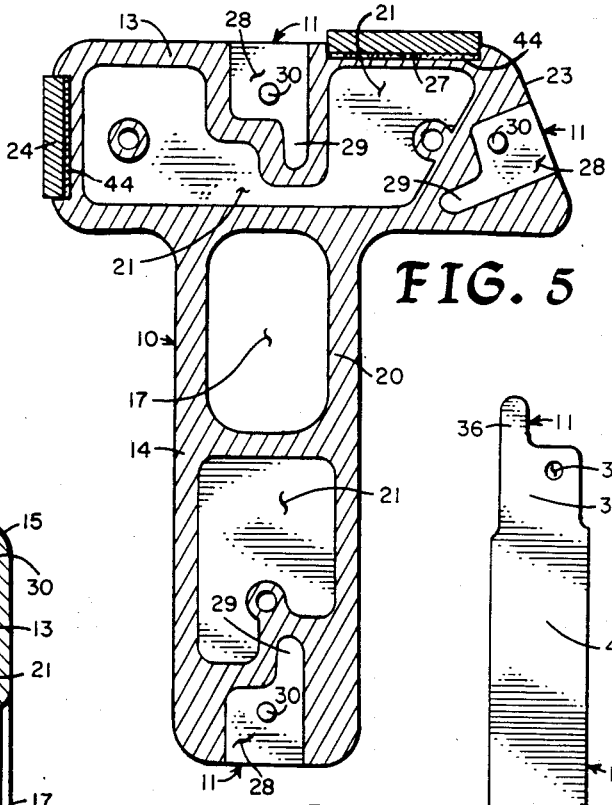
FIG. 5
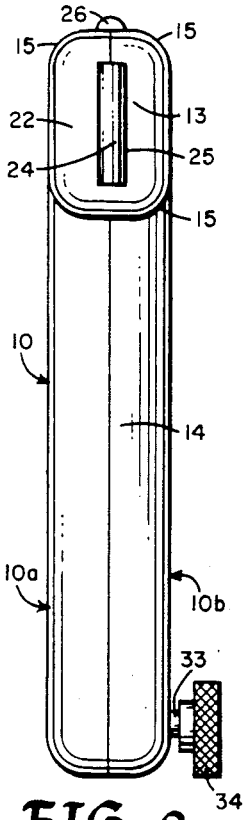
FIG. 2
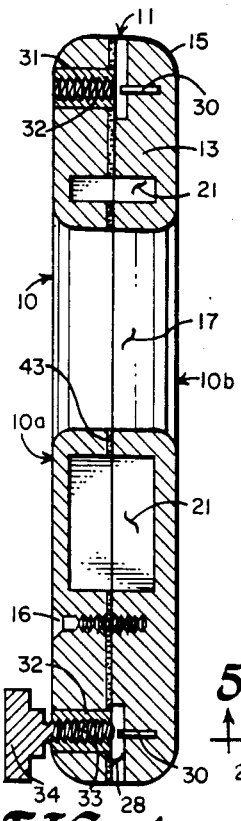
FIG. 4
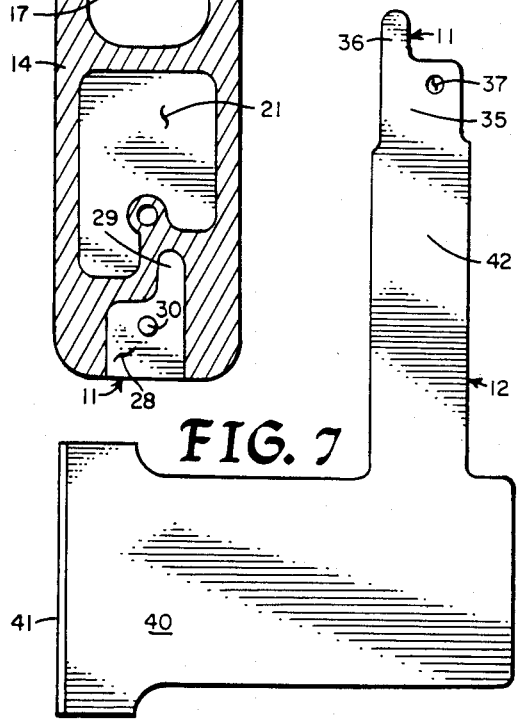
FIG. 7
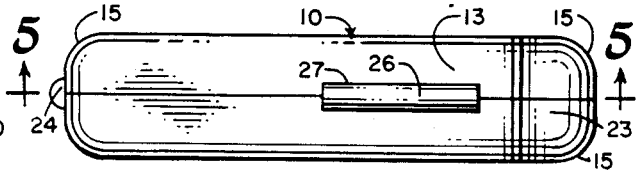
FIG. 3

SPORTSMAN'S TOOL HANDLE

BACKGROUND OF INVENTION

1. Related Applications

There are no applications related hereto heretofore filed in this or any foreign country.

2. Field of Invention

My invention is a handle which may be releasably interconnected with a plurality of blade type tool elements.

3. Description of Prior Art

Sportsmen often require small hand tools for the pursuit of their chosen endeavors and, in fact, their very lives may at times depend upon such tools. This is especially true of hunters of larger game animals who may be more separated from civilized areas and oftentimes require hand tools to properly deal with and process animals which they may kill.

Ordinary hand tools, as used by the populace generally, have been used by sportsmen, but generally they are not too well adapted to such use, especially because of their lack of versatility and compactness, both of which are desirable because the tools may need to be carried substantial distances. Compound-type hand tools heretofore known have provided these features to some degree but have not become particularly popular amongst sportsmen because these tools have not generally been so useful or functional as a unitary type tool. Utility and function in a tool are of substantial concern to a sportsman because the success of a hunt and the sportsman's well being itself may depend on these features of his tools.

The instant invention provides a multipurpose tool handle that may releasably carry a variety of common tool elements, especially those of a blade type such as a knife, saw or hatchet. The handle is particularly configured to meet the requirements of sportsmen generally and especially the hunter of big game animals. The handle is of a metal formed to a "T" shape with a medial finger hole and means of fastening tools at each end of the elements forming the "T" so that the handle may mount a tool parallel or perpendicular to either handle element. The metal structure provides appropriate strength and rigidity but yet allows formation of internal air chambers to provide floatation. The medial finger hole provides better grasping capabilities than other handle configurations without finger holes.

Tool elements are releasably fastened to the handle by particular common shank structure which provides substantial rigidity for the interconnected elements. A tool shank extends for some distance into an interfitting chamber to resist skewing forces and an interfitting pin structure is provided to resist substantial pulling or pushing forces parallel to the tool shank. This interconnection of elements provides substantially the same rigidity and strength as are provided by unitary tools of the same type. The connecting shank is of a type heretofore known and readily available on various blade-type tools of the present day market place.

One of the tool holding orifices of my handle is angled to the axis of the handle element wherein it is defined, to include somewhat more than a ninety degree angle between the tool held therein and the adjacent perpendicular handle element to allow interconnection of a saw blade for sawing operations with a normal hand positioning.

My handle provides ancillary features of a small sharpening stone and a flintstone that may be used with a piece of steel for fire starting.

My invention resides not in any one of these features per se but rather in all of the structural and functional elements of my invention combined in the unique synergistic relationship specified and claimed.

SUMMARY OF INVENTION

My invention generally provides a "T" shaped handle of somewhat rectilinear cross section providing tool fastening structures at end parts to releasably interconnect various tool elements having a particular common shank structure.

The handle is formed of metal, with internal chambers to provide floatation, and defines a medial finger hole to aid grasping. The body provides an externally projecting sharpening stone and flint element for fire starting. The tool fastening means each define a chamber to contain the particularly configured shank of a tool element. The handle will releasably interconnect at various positions a plurality of tool elements which are available in present day commerce. The handle comprises two similar releasably joined halves to allow easy formation and definition of internal structure.

In creating such a device it is:

A principal object of my invention to provide a tool handle that may be well and firmly grasped by reason of its configuration and yet may be used to releasably interconnect a plurality of tool elements at various positions about its periphery to allow variously oriented handle arrangements for any such tools.

A further object of my invention to provide such a tool handle that is formed of metal for substantial rigidity and durability but yet defines internal enclosed chambers to provide for floatation in water.

A further object of my invention to provide such a tool handle that defines tool shank chambers with pin structure to releasably interconnect a particular tool shank in a rigid, strong joinder of the same nature as a unitary tool of some type.

A still further object of my invention to provide such a tool handle that has an angularly orientated tool shank chamber in which a saw blade may be carried to define a central angle somewhat greater than ninety degrees with one handle element for normally positioned, comfortable sawing.

A still further object of my invention to provide such a tool handle that has an externally projecting sharpening stone and fire flint.

A still further object of my invention to provide such a tool handle that is of new and novel design, of rugged and durable nature, of simple and economic manufacture, and one otherwise well suited to the uses and purposes for which it is intended.

Other and further objects of my invention will appear from the following specification and accompanying drawings which form a part hereof. In carrying out the objects of my invention, however, it is to be understood that it's essential features are susceptible of change and design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 1 is an orthographic side view of my handle, with a partially cut away saw blade therein, showing its various parts, their configuration and relationship.

FIG. 2 is an end view taken from the left of the handle of FIG. 1 showing the various handle features from this aspect.

FIG. 3 is an orthographic top view of the handle of FIG. 1 showing its features from this aspect.

FIG. 4 is a vertical cross-sectional view of the internal structure of my handle, particularly showing floatation and shank chambers, taken on the line 4—4 of FIG. 2, in the direction indicated by the arrows thereon.

FIG. 5 is a vertical cross-sectional view of the handle of FIG. 1, taken on the line 5—5 of FIG. 1 in the direction indicated by the arrows thereon.

FIG. 6 is an orthographic side view of a knife-type blade for use with my handle.

FIG. 7 is an orthographic side view of a hatchet-type tool element for use with the handle of my invention.

DESCRIPTION OF THE PREFERRED EMBODIMENT

My invention generally comprises a multi-purpose tool handle 10 defining a plurality of tool fastening structures 11 about its periphery to releasably interconnect various tool elements 12 therein.

Handle 10 comprises a rigid "T" shaped element with shorter arm 13 communicating perpendicularly in its medial portion with the end part of longer arm 14. These elements are of generally rectilinear cross-sectional shape with their peripheral edges 15 rounded and of appropriate size to provide a peripheral surface that is easy to grasp and comfortable to hold. The medial portion of longer arm 14, immediately adjacent the interconnection of that arm with shorter arm 13, defines rectilinear finger hole 17, again having its edges 18 and corners 19 rounded to provide a conformable finger hole for manual grasping.

Handle 10 is preferably formed of two peripherally similar halves 10*a* and 10*b*. Letters 'a' and 'b' are hereinafter sometimes appended to numbers of various handle parts to indicate that particular part on one or the other half of my handle. Inner surfaces 20 of each of the handle elements join in a planar conformable fit. The two handle halves are releasably maintained in adjacent position by plural inset headed screws 16 threadedly engaged therebetween.

Each handle half defines plural intercommunicating floatation chambers 20, defining an appropriate volume to make the composite density of my handle, and preferably also of any tool held therein, less than the density of water so that the structure will float in water. The size and shape of these floatation chambers is not critical so long as their volume be sufficient to accomplish their purpose and so long as they are sealed in water tight fashion when the two halves of my handle are in adjacency. Preferably to aid this joinder, a thin film of some type of sealant or adhesive 43 is placed between the immediately adjacent surfaces of the two handle halves before they are joined by screws 16 to assure the seal therebetween. Various known types of interfitting joints, with or without gaskets, (not shown) might also be used for this purpose, if desired.

Shorter arm 13 of the handle element provides one perpendicular end 22 and one angled end 23, configured as illustrated especially in FIG. 1, with the inwardmost portion of the angled end at the longer side of shorter arm 13 opposite its junction with longer arm 14. The angled end is so configured to allow proper fastening and positioning of a saw blade, so that it may be used in a normal position for manual operation when a saw blade be positioned in the fastening structure defined in the angled end and the handle be held by longer arm 14. To accomplish this positioning, the included angle between the axis of handle element 14 and saw blade should be about 110 degrees.

Perpendicular end 22 of the shorter handle arm provides elongate cylindrical sharpening stone 24 carried in groove 25 partially defined in the adjacent medial parts of both handle elements to conformab1y fit about a portion of the sharpening stone to allow fastening of the stone. The stone is configured to have a portion projecting outwardly a spaced distance from the handle element to allow its use and is positionally maintained in the handle element by adhesion of the adjacent surfaces.

Outer surface 43 of the shorter arm, opposite its interconnection with longer arm 14, carries flint 26 in channel 27 defined in the adjacent medial portions of both handle halves. The flint is positionally maintained in chamber 27 by adhesion of the adjacent surfaces and it is of such configuration that a portion extends a spaced distance outwardly from the handle to allow access to a striking surface for creation of sparks for fire starting.

Tool fastening structures 11 comprise particularly configured shank chambers 28, having narrower inwardly projecting arm 29 and a thickness approximately twice that of a tool shank to be carried therein, defined in the handle element. The shank chambers illustrated are three in number and preferably positionally arrayed as illustrated for maximum convenience and use, in the outer end of longer arm 14, in the medial portion of shorter arm 13 on the side opposite the interconnection of the longer arm therewith, and in the angled end of the shorter arm. These chambers obviously may be of greater or lesser number and may be otherwise positioned than as illustrated. Preferably for ease of construction of my handle, the shank chambers are defined in only one-half of my handle element, in the instance illustrated the half 10*b*, and they extend from the plane of inner surfaces 20 inwardly into that handle half. The shank chambers obviously may be otherwise defined, such as in a medial position of either handle element or partially between both handle elements, without departing from the spirit or essence of my invention.

Each shank chamber has an associated fastening pin 13 carried by the adjacent handle structure and extending therein to a distance approximately one-half of the thickness of the chamber to allow a tool shank to be passed thereover within the chamber and thereafter be fastened over the pin. Handle element 10*a* defines threaded fastening screw holes 31, each positioned to communicate with a medial part of the associated fastening chamber but not with fastening pins 30. This fastening screw hole may be defined in a cylindrical fastening screw insert 32 structurally carried by the handle element as illustrated or in the handle element itself. Fastening screw hole 31 threadedly engages the shank of fastening screw 33 having larger cylindrical head 34 with a knurled peripheral surface to aid manual manipulation. The fastening screw is so configured that its inner end part 35 may extend into the opposed shank chamber 28 for some slight distance to the adjacent surface of the fastening shank of a tool therein.

This fastening structure defined is not new per se and has, in its essence and the configuration illustrated, heretofore become known. There are in the present day market place various cutting blade type tools, particularly of the saw type, that have shanks configured to fit within such a fastening structure. This general type of fastening structure, however, is well adapted for use with my handle because it does give a very strong and firm but yet releasable joinder of tool elements which is required for my handle to be most useful and effective. Both the inwardly projecting arm and passage of fastening pin 30 through the shank of a tool element carried in the fastening chamber tend to prevent either any skew-type motion of the blade relative to the handle or an elongate motion between these elements. The joinder is also of substantial durability and generally does not wear readily to allow motion of the parts relative to each other, which induces further wear and lessens strength.

Tool elements 12 may take many and various forms, but all have fastening shank 35 of configuration adapted to well fit within shank chamber 28. This shank includes inwardly projecting arm 36 and fastening pin hole 37, both configured and positioned to cooperate with the corresponding parts of the shank chamber to accomplish the required nice fit therebetween.

Various types of cutting tools which may be used with my handle are illustrated. A tool having a serrated saw-type cutting edge 38 is illustrated partially in FIG. 1 of the drawings. A tool having a straight knife-type edge 39 is illustrated in FIG. 6. A tool having a hatchet head 40 with cutting edge 41 extending substantially perpendicular to an elongate shank 42 is illustrated in FIG. 7. Various other shank-type tools such as hammers, spoons or the like that are known but not illustrated may be used with my invention.

Having thusly described my invention, its use may be readily understood.

Firstly, a tool is formed according to the foregoing specification and assembled by joining its two halves together in sealed adjacency by screws 16 and fastening sharpening stone 24 and flint 26 in their respective channels by adhesion with known commercial adhesives 44. Preferably before the two halves of the handle element are fastened together, their adjacent surfaces will be covered with some known type of adhesive or sealing compound 43 which will assure a water-tight joinder of the adjacent surfaces.

With the handle thusly assembled, a shank-type tool such as described is placed by manual manipulation with its fastening shank 35 in one of the shank chambers 28 and with its pin hole 37 carrying fastening pin 30. If the tool used be a saw-type blade, it is preferably positioned in the fastening chamber defined inwardly adjacent angled end 23 of shorter arm 13 as illustrated in FIG. 1. With the blade in this fastening position, the handle may be manually grasped by its longer arm 14 to allow saw blade positioning in a normal conformable position for use, with an included angle somewhat greater than ninety degrees between the axis of the blade and the axis of the handle being grasped. Any other blades would be positioned in such fastening structures as desired for a particular use.

After a tool is positioned in the handle as described, fastening screw 33 is threadedly engaged in the hole associated with that particular fastening chamber and the screw is tightened downwardly against the adjacent surface of the shank of the tool being used to releasably but fixedly maintain the blade. With the handle and tool in this relationship, the tool may then be used by grasping the handle and manually manipulating it in the normal fashion as has heretofore been done in the use of such tools of the same general type.

When it be desired to release a particular tool, fastening screw 33 is released and the tool shank removed from the handle by operations that are the reverse of those described that caused its establishment.

It is to be particularly noted from the foregoing description that finger hole 17 is defined where it may be readily used whether the handle be grasped by shorter arm 13 or longer arm 14 and that the finger hole may be used by various of the fingers as desired by the user. This finger hole tends to give a firmer, better established grip on the handle and one which may not be so readily disengaged as on a tool handle of the same configuration without a finger hole.

The tool handle of my invention must be formed of some reasonably rigid, durable material. The materials of preference are one of the less dense aluminum alloys that provide substantial strength or one of the harder plastics which also provide both appropriate strength and rigidity. Undoubtedly other similar materials of reasonably low density may be used for the purpose, if not so well. If the handle be formed of metal it may not be necessary to provide fastening screw inserts 32 but, generally, even in the case of aluminum alloys, it is preferable to provide such an insert formed of mild steel or similar material more durable than the handle material to avoid thread stripping. Preferably for rigidity and durability, fastening pin 30 will be formed of steel.

It is further to be noted that the sharpening stone and flint element may be used in their normal fashion to sharpen the cutting surfaces of tools or to create sparks respectively. It should be remembered that the tool elements used with my handle are normally formed of a hard steel and may therefore be conveniently used to strike the flint element to cause sparks for a fire.

The foregoing description of my invention is necessarily of a detailed nature so that a specific embodiment of it may be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A "T" shaped handle element for a plurality of releasably engagable tools, comprising, in combination;

a rigid shorter arm of trapezoidal peripheral and rectilinear cross-sectional shape with rounded corners and edges having one angled end and structurally communicating in its medial portion with with a longer arm of cross sectional shape, said longer arm defining a finger hole with rounded edges and corners in its medial portion immediately inwardly adjacent its communication with the shorter arm, said handle being formed by two peripherally similar halves releasably joined at adjacent medial planar surfaces and maintained in structural communication by at lease one mechanical fastener communicating therebetween;

at least one floatation chamber defined within the handle element to lessen the composite density thereof to cause the handle to float in water;

plural similar tool fastening structures defined about the periphery of the handle to accept similar shanks of a plurality of tools, said tool fastening structures comprising a fastening chamber of the same peripheral configuration as the fastening shank of a tool to be therein contained, a fastening pin extending part way into the fastening chamber to allow passage of a tool shank thereover and to receive the hole of a shank thereabout, and a fastening screw threadedly engaged in the handle element in a position to extend into the associated fastening chamber and extending in the opposite direction from the fastening pin through the handle element to allow releasable fastening of the fastening shank of a tool in the fastening chamber;

a sharpening stone carried by the end of the shorter arm opposite its angled end, said stone extending a spaced distance from the handle element; and a flintstone carried by the periphery of the handle element and extending a spaced distance therefrom.

2. The invention of claim 1 combined with a tool having a fastening shank, in the end part of a tool shank, defining an element of peripheral configuration substantially coincident with that of the fastening structure defined by the handle and a thickness less than half that of said fastening chamber so that a tool shank may be placed within the fastening chamber and over the associated fastening pin by manual manipulation.

* * * * *